US011004419B1

(12) United States Patent
Zhang

(10) Patent No.: US 11,004,419 B1
(45) Date of Patent: May 11, 2021

(54) MURA COMPENSATION OPTIMIZATION METHOD AND SYSTEM FOR LIQUID CRYSTAL DISPLAY PANEL

(71) Applicant: Shenzhen China Star Optoelectronics Semiconductor Display Technology Co., Ltd., Shenzhen (CN)

(72) Inventor: Hua Zhang, Shenzhen (CN)

(73) Assignee: SHENZHEN CHINA STAR OPTOELECTRONICS SEMICONDUCTOR DISPLAY TECHNOLOGY CO., LTD., Guangdong (CN)

( * ) Notice: Subject to any disclaimer, the term of this patent is extended or adjusted under 35 U.S.C. 154(b) by 373 days.

(21) Appl. No.: 16/304,679

(22) PCT Filed: Sep. 20, 2018

(86) PCT No.: PCT/CN2018/106594
§ 371 (c)(1),
(2) Date: Nov. 26, 2018

(87) PCT Pub. No.: WO2020/000702
PCT Pub. Date: Jan. 2, 2020

(30) Foreign Application Priority Data

Jun. 27, 2018 (CN) ..... 201810679365.X

(51) Int. Cl.
*G09G 3/36* (2006.01)

(52) U.S. Cl.
CPC ..... *G09G 3/3688* (2013.01); *G09G 2310/027* (2013.01); *G09G 2310/08* (2013.01); *G09G 2320/0233* (2013.01); *G09G 2320/0626* (2013.01)

(58) Field of Classification Search
CPC ..... G09G 3/3688; G09G 2310/027; G09G 2310/08; G09G 2320/0233; G09G 2320/0626
USPC ..... 345/99
See application file for complete search history.

(56) References Cited

U.S. PATENT DOCUMENTS

2009/0135211 A1 5/2009 Wang et al.
2010/0013751 A1* 1/2010 Kerofsky ..... G09G 3/3611 345/89

FOREIGN PATENT DOCUMENTS

CN 105278129 A 1/2016
CN 105590604 A 5/2016
CN 106125367 A 11/2016
CN 106991987 A 7/2017
CN 107203056 A 9/2017
CN 108109573 A 6/2018
(Continued)

*Primary Examiner* — Mark Edwards
(74) *Attorney, Agent, or Firm* — Leong C. Lei

(57) ABSTRACT

A Mura compensation optimization method and system for liquid crystal display panel is disclosed. The method detecting the received original picture data signal and determining whether an original picture is a grayscale transition picture or a single grayscale value picture by a timing controller; and when determining that the original picture is a grayscale transition picture or not a single grayscale value picture, turning off a Mura compensation function by the timing controller. The present invention can avoid the phenomenon of display abnormality caused by Mura compensation under some specific screens, and optimize the Mura compensation effect of the liquid crystal display panel.

10 Claims, 4 Drawing Sheets

(56) References Cited

FOREIGN PATENT DOCUMENTS

| | | | |
|---|---|---|---|
| CN | 105278129 B | * | 9/2018 |
| KR | 101232178 B1 | | 2/2013 |

* cited by examiner

MURA COMPENSATION OPTIMIZATION METHOD AND SYSTEM FOR LIQUID CRYSTAL DISPLAY PANEL

FIELD OF THE INVENTION

The present invention relates to a display technology field, and more particularly to a Mura compensation optimization method and system for liquid crystal display panel.

BACKGROUND OF THE INVENTION

The Liquid crystal display (LCD) panel has developed rapidly in recent years and has become mainstream product on the market, and has been widely applied: such as televisions, smart phones, tablet computers, computer panels, and the like.

Under the conventional technical conditions, due to poor raw materials or some uncontrollable factors in the actual process, the liquid crystal display panel product often generates an uneven brightness phenomenon when displaying images, that is, a Mura phenomenon called by the industry. Especially, when the liquid crystal display panel displays a white picture, the Mura phenomenon is especially obvious.

In order to eliminate the Mura on the liquid crystal display panel and improve the product quality, the display panel manufacturer will use the Mura compensation system to perform compensation: as shown in FIG. 1 and FIG. 2, the liquid crystal display panel 200 is first photographed by a camera 100 under the grayscale of a white picture. The brightness distribution is then calculated by a compensation data calculation unit 300 based on a center point of the liquid crystal display panel 200, and a grayscale compensation value of each region of the liquid crystal display panel 200 is calculated according to a corresponding curve of the brightness and the grayscale to reduce the grayscale value of a bright region and increase the grayscale value of a dark region, the grayscale compensation value is written into a flash card 400, and after a timing controller (TCON) 500 that drive the liquid crystal display panel 200 to display is powered on, the grayscale compensation value stored in the flash card 400 is read out, and the grayscale compensation value and the inputted original picture data signal are calculated by the Mura compensation function module 501 in the timing controller 500 to perform the Mura compensation. The Mura phenomenon on the liquid crystal display panel 200 is eliminated or attenuated.

The above-mentioned conventional Mura compensation system has certain technical defects: as long as there is a grayscale compensation value, the timing controller 500 performs the Mura compensation on all pictures, but performing Mura compensation on some specific pictures may cause display abnormality. For example, in the horizontal or vertical grayscale transition picture shown in FIG. 3, the inputted grayscale values of the regions of the liquid crystal display panel 200 are different (the adjacent regions are different by one grayscale), and if the grayscale compensation value is added, The grayscale values of different regions may become the same, or the difference is less than one grayscale, which will cause the grayscale transition boundary to be indistinguishable, forming a grayscale transition as shown in FIG. 4, and the liquid crystal display panel is not smooth, which affect the judgment of the quality of liquid crystal display panels.

SUMMARY OF THE INVENTION

The purpose of the present invention is to provide a Mura compensation optimization method for liquid crystal display pane, which can avoid the phenomenon of display abnormality caused by Mura compensation under some specific screens, and optimize the Mura compensation effect of the liquid crystal display panel.

Another purpose of the present invention is to provide a Mura compensation optimization system for liquid crystal display panel, the Mura compensation function can be turned off or on according to the difference of the inputted original picture data signal so as to avoid the Mura compensation in some specific pictures so as to cause an abnormal display phenomenon.

In order to achieve the above object, the present invention first provides a Mura compensation optimization method for liquid crystal display panel, comprising steps of: step S1: receiving an original picture data signal inputted from a liquid crystal display panel, detecting the received original picture data signal and determining whether an original picture is a grayscale transition picture or a single grayscale value picture by a timing controller; step S2: when determining that the original picture is a grayscale transition picture or not a single grayscale value picture, turning off a Mura compensation function by the timing controller; step S3: when determining that the original picture is the single grayscale value picture or not the grayscale transition picture, the timing controller turns on the Mura compensation function.

Optionally, in the step S1, the timing controller is provided with a receiving module and a detection determination function module electrically connected to the receiving module, and a Mura compensation function module electrically connected to the detection determination function module; the receiving module receives the original picture data signal inputted from the liquid crystal display panel, the detection determination function module detects the received original picture data signal and determines whether the inputted original picture is the grayscale transition picture; in the step S2, when determining that the original picture is a grayscale transition picture, the timing controller controls the Mura compensation function module to turn off the Mura compensation function, and directly outputs the uncompensated original picture data signal to the liquid crystal display panel; and in the step S3, when determining that the original picture is not the grayscale transition picture, the timing controller controls the Mura compensation function module to turn on the Mura compensation function, and the original picture data signal and the grayscale compensation data are outputted to the liquid crystal display panel after performing a calculation.

Optionally, in the step S1, the timing controller is provided with a receiving module, a detection determination function module electrically connected to the receiving module, and a Mura compensation function module electrically connected to the detection determination function module; wherein the receiving module receives the original picture data signal input from the liquid crystal display panel, the detection determination function module detects the received original picture data signal and determines whether the inputted original picture is the single grayscale value picture; in the step S2, when determining that the original picture is not the single grayscale value picture, the timing controller controls the Mura compensation function module to turn off the Mura compensation function, and directly outputs the uncompensated original picture data signal to the liquid crystal display panel; and in the step S3, when determining that the original picture is a single grayscale value picture, the timing controller controls the Mura compensation function module to turn on the Mura compensation function, and the original picture data signal and the grayscale compensation data are outputted to the liquid crystal display panel after a calculation.

Optionally, the grayscale compensation data is stored in a flash card electrically connected to the Mura compensation function module.

Optionally, a process of acquiring the grayscale compensation data is: firstly, capturing a brightness distribution of the liquid crystal display panel 1 under the grayscale of a white picture by a camera, and then a compensation data calculation unit calculates a grayscale compensation value of each region of the liquid crystal display panel according to a corresponding curve of the brightness and the grayscale based on a center point of the liquid crystal display panel, and finally writes the grayscale compensation value to the flash card.

Optionally, the single grayscale value picture may be a pure red picture, a pure green picture, a pure blue picture, a pure white picture, or a picture mixed by any two colors of red, green, and blue.

The present invention also provides a Mura compensation optimization system for liquid crystal display panel, comprising: a timing controller electrically connected to a liquid crystal display panel, wherein the timing controller is provided with a receiving module, a detection determination function module electrically connected to the receiving module and a Mura compensation function module electrically connected to the detection determination function module; the receiving module is configured to receive an original picture data signal inputted from the liquid crystal display panel; the detection determination function module is configured to detect the received original picture data signal and determine whether an original picture is a grayscale transition picture or a single grayscale value picture; and the Mura compensation function module is configured to turn off its own Mura compensation function when the original picture is a grayscale transition picture or not a single grayscale value picture.

Wherein the system further comprises: a camera for capturing a brightness distribution of the liquid crystal display panel 1 under a grayscale of a white picture; a compensation data calculation unit electrically connected to the camera for calculating a grayscale compensation value of each region of the liquid crystal display panel according to a corresponding curve of the brightness and the grayscale based on a center point of the liquid crystal display panel; and a flash card electrically connected to the compensation data calculation unit and the Mura compensation function module for storing the grayscale compensation value.

Wherein the Mura compensation function module is also used to turn on its own Mura compensation function when the original picture is a single grayscale value picture or not a grayscale transition picture.

The beneficial effects of the invention: the present invention provides a Mura compensation optimization method for liquid crystal display panel, through detecting the received original picture data signal and determining whether an original picture is a grayscale transition picture or a single grayscale value picture by a timing controller, when determining that the original picture is a grayscale transition picture or not a single grayscale value picture, turning off a Mura compensation function by the timing controller, which can avoid the occurrence of display abnormality by performing the Mura compensation on a specific picture such as the grayscale transition picture or the single grayscale value picture, optimizing the Mura compensation effect of the liquid crystal display panel. The Mura compensation optimization system for liquid crystal display panel, through detecting the received original picture data signal and determining whether an original picture is a grayscale transition picture or a single grayscale value picture by a timing controller, when determining that the original picture is a grayscale transition picture or not a single grayscale value picture, turning off a Mura compensation function by the timing controller, which can avoid the occurrence of display abnormality by performing the Mura compensation on a specific picture such as the grayscale transition picture or the single grayscale value picture, optimizing the Mura compensation effect of the liquid crystal display panel.

BRIEF DESCRIPTION OF THE DRAWINGS

For a better understanding of the features and technical aspects of the present invention, reference should be made to the accompanying drawings. However, the drawings are provided for purposes of illustration and description only and are not intended to be limiting.

In the drawings.

DETAILED DESCRIPTION OF PREFERRED EMBODIMENTS

In order to further clarify the technical means and effects of the present invention, the following detailed description will be made in conjunction with the preferred embodiments of the invention and the accompanying drawings.

Figure 5:
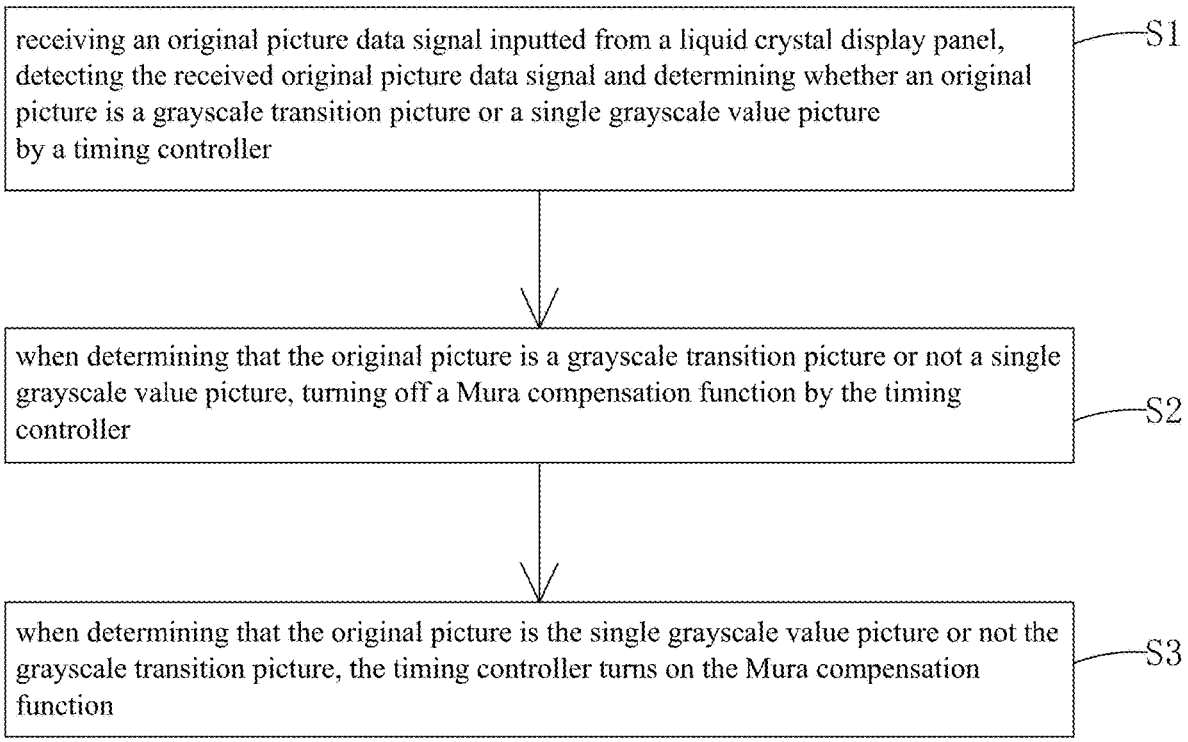
FIG. 5 is a flow chart of a Mura compensation optimization method for liquid crystal display of a liquid crystal display panel of the present invention.
Figure 6:
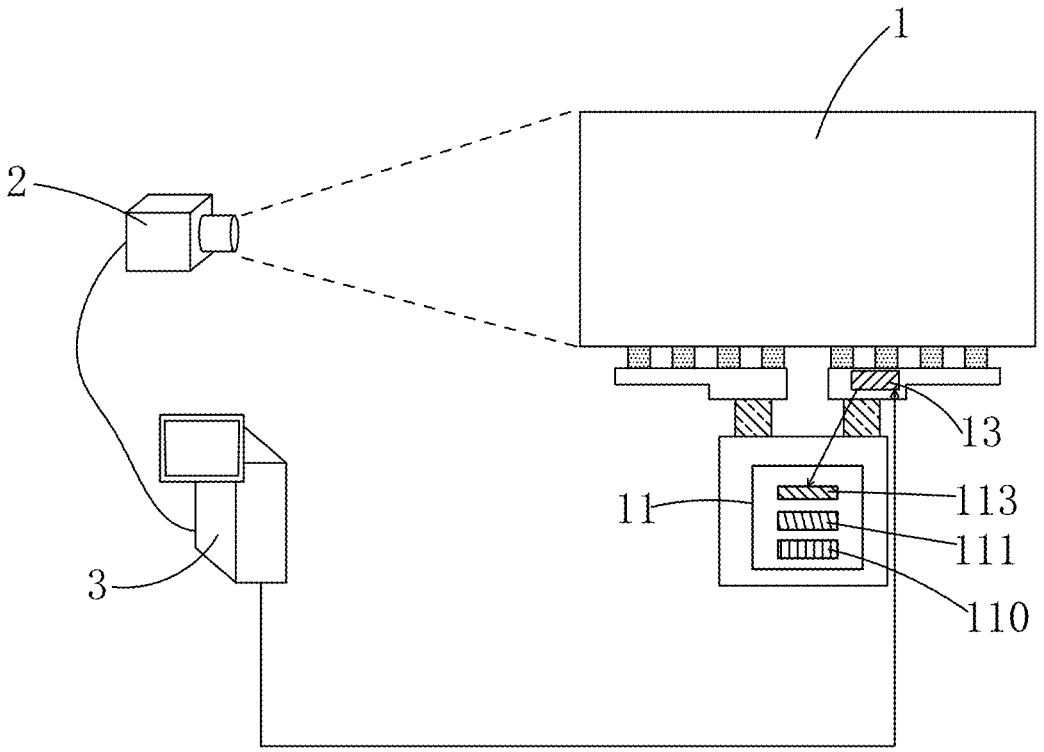
FIG. 6 is a schematic structural diagram of a Mura compensation optimization system for a liquid crystal display panel of the present invention.

Referring to FIG. 5 and FIG. 6, the present invention first provides a Mura compensation optimization method for liquid crystal display panel, which includes the following steps:

Step S1, receiving an original picture data signal inputted from a liquid crystal display panel 1, detecting the received original picture data signal and determining whether an original picture is a grayscale transition picture or a single grayscale value picture by a timing controller 11;

Step S2, when determining that the original picture is a grayscale transition picture or not a single grayscale value picture, turning off a Mura compensation function by the timing controller 11;

Step S3: When determining that the original picture is the single grayscale value picture or not the grayscale transition picture, the timing controller 11 turns on the Mura compensation function.

Specifically, in the first embodiment of the Mura compensation optimization method of the liquid crystal display panel of the present invention:

In the step S1, providing a liquid crystal display panel 1. A periphery of the liquid crystal display panel 1 is provided with a timing controller 11, the timing controller 11 is provided with a receiving module 110 and a detection determination function module 111 electrically connected to the receiving module 110, and a Mura compensation function module 113 electrically connected to the detection determination function module 111. Wherein the receiving module 110 receives the original picture data signal inputted from the liquid crystal display panel 1; the detection determination function module 111 detects the received original picture data signal and determines whether the inputted original picture is the grayscale transition picture.

Figure 1:
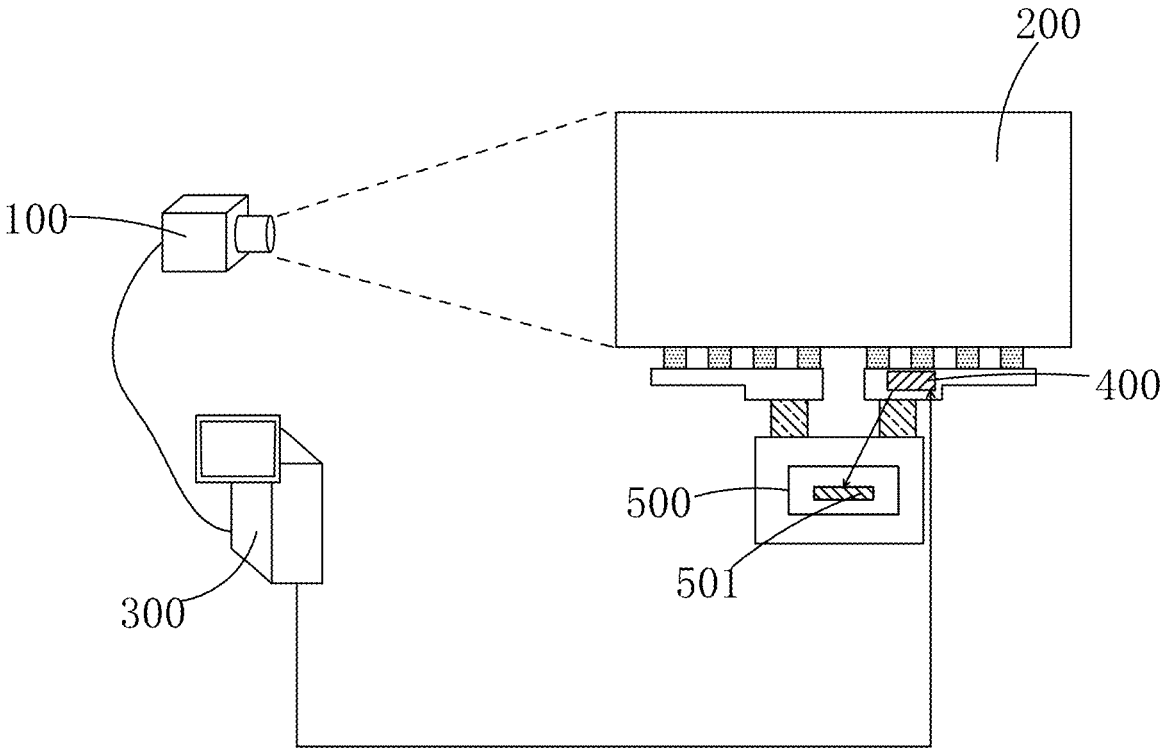
Fig. 1(Prior art)
FIG. 1 is a schematic structural diagram of a conventional Mura compensation system for liquid crystal display panel.
Figure 2:
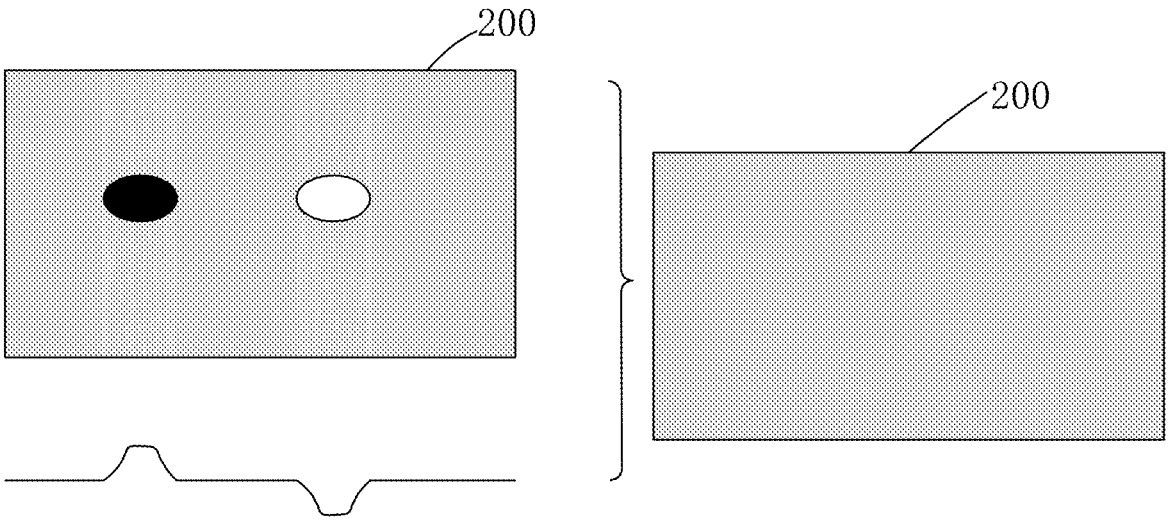
Fig. 2(Prior art)
FIG. 2 is a schematic diagram of a conventional Mura compensation system for liquid crystal display panel for reducing a grayscale value of a bright region and increasing a grayscale value of a dark region.
Figure 3:
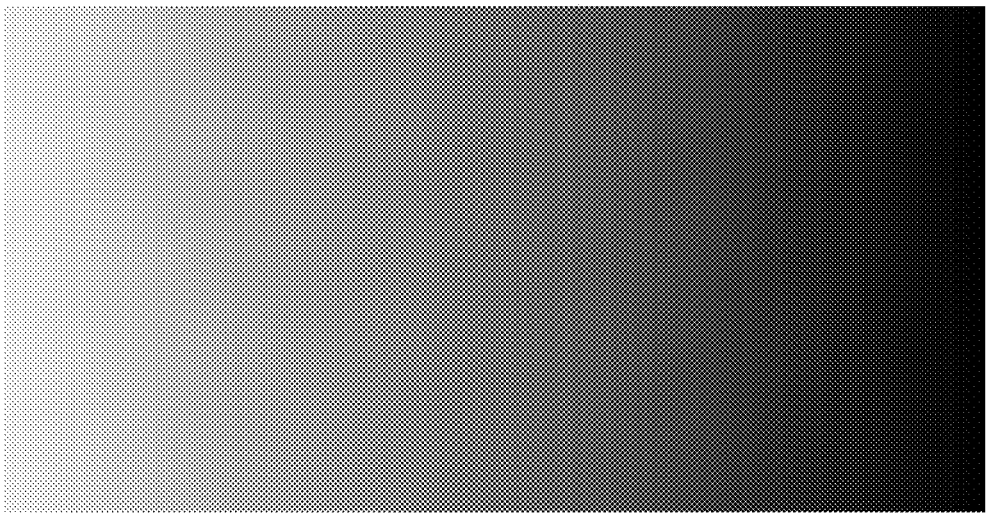
Fig. 3(Prior art)
FIG. 3 is a schematic diagram of a vertical grayscale transition picture.

Referring to FIG. 3, the grayscale transition picture may be a horizontal grayscale transition picture or a vertical grayscale transition picture. Under the grayscale transition picture, inputted grayscale values of regions of the liquid crystal display panel are different (the adjacent regions are different by one grayscale value).

In the step S2, when determining that the original picture is a grayscale transition picture, the timing controller 11 controls the Mura compensation function module 113 to turn off the Mura compensation function, and directly outputs the uncompensated original picture data signal to the liquid crystal display panel 1;

In the step S3, when determining that the original picture is not the grayscale transition picture, the timing controller 11 controls the Mura compensation function module 113 to turn on the Mura compensation function, and the original picture data signal and the grayscale compensation data are outputted to the liquid crystal display panel 1 after performing a calculation.

Figure 4:
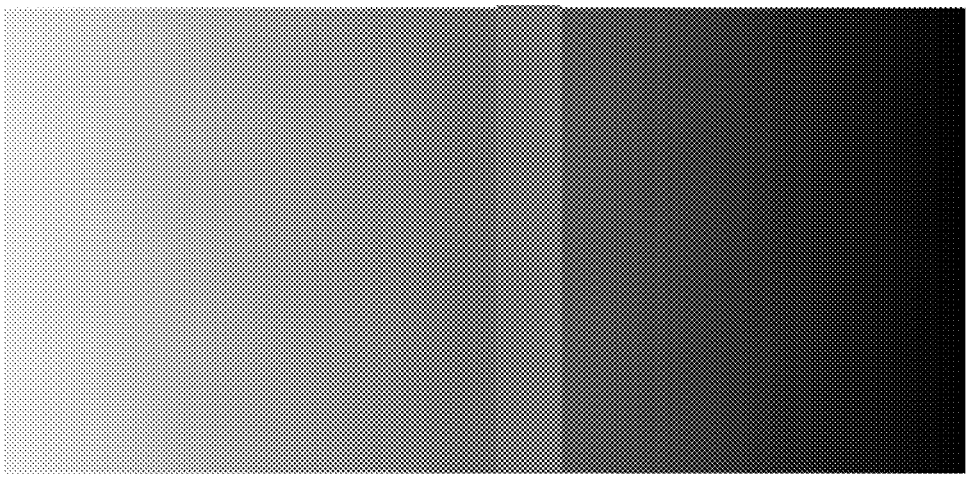
Fig. 4(Prior art)
FIG. 4 is a schematic diagram of a conventional Mura compensation system for liquid crystal display panel for showing a grayscale transition is not smooth after the Mura compensation for the vertical grayscale transition picture.

That is to say, if the inputted original picture is a grayscale transition picture, the grayscale compensation processing is not performed on the original picture data signal, and the output of the liquid crystal display panel 1 is a grayscale transition picture without the Mura compensation, then the adjacent regions of the liquid crystal display panel 1 still maintains a fixed difference of one grayscale, and there is no display abnormality that the grayscale transition boundary is unable to be distinguished and the grayscale transition is not smooth as shown in FIG. 4. If the inputted original picture is not the grayscale transition picture, the grayscale compensation processing is performed on the original picture data signal, and the liquid crystal display panel 1 outputs a picture subjected to the Mura compensation, which eliminates or weakens the Mura phenomenon of the liquid crystal display panel 1, and the display brightness is more uniform.

Specifically, the grayscale compensation data is stored in a flash card 13 disposed at a periphery of the liquid crystal display panel 1 and electrically connected to the Mura compensation function module 113. Further, referring to FIG. 6, a process of acquiring the grayscale compensation data is: firstly, capturing a brightness distribution of the liquid crystal display panel 1 under the grayscale of a white picture by a camera 2, and then a compensation data calculation unit 3 calculates a grayscale compensation value of each region of the liquid crystal display panel 1 according to a corresponding curve of the brightness and the grayscale based on a center point of the liquid crystal display panel 1, and finally writes the grayscale compensation value to the flash card 13.

In a second embodiment of the Mura compensation optimization method of the liquid crystal display panel of the present invention:

In the step S1, the liquid crystal display panel 1 is provided. The periphery of the liquid crystal display panel 1 is provided with a timing controller 11. The timing controller 11 is provided with a receiving module 110, a detection determination function module 111 electrically connected to the receiving module 110, and a Mura compensation function module 113 electrically connected to the detection determination function module 111; the receiving module 110 receives the original picture data signal input from the liquid crystal display panel 1; the detection determination function module 111 detects the received original picture data signal and determines whether the inputted original picture is the single grayscale value picture.

Specifically, the single grayscale value picture may be a pure red picture, a pure green picture, a pure blue picture, a pure white picture, or a picture mixed by any two colors of red, green, and blue.

In the step S2, when determining that the original picture is not the single grayscale value picture, the timing controller 11 controls the Mura compensation function module 113 to turn off the Mura compensation function, and directly outputs the uncompensated original picture data signal to the liquid crystal display panel 1.

In the step S3, when determining that the original picture is a single grayscale value picture, the timing controller 11 controls the Mura compensation function module 113 to turn on the Mura compensation function, and the original picture data signal and the grayscale compensation data are outputted to the liquid crystal display panel 1 after a calculation.

That is to say, if the inputted original picture is the single grayscale value picture, performing a grayscale compensation processing to the original picture data signal, and the liquid crystal display panel 1 outputs a picture subjected to the Mura compensation, which eliminates or reduces the Mura phenomenon on liquid crystal display panel 1, and the display brightness is more uniform. If the inputted original picture data signal is not the single grayscale value picture, but the grayscale transition picture or other unknown special picture, then, the original picture data signal is not subjected to the grayscale compensation processing, and the liquid crystal display panel 1 outputs the original picture without the Mura compensation, which can avoid the occurrence of display abnormality by performing the Mura compensation on a specific picture such as the grayscale transition picture or the single grayscale value picture.

Specifically, the grayscale compensation data is stored in a flash card 13 disposed at a periphery of the liquid crystal display panel 1 and electrically connected to the Mura compensation function module 113. Further, referring to FIG. 6, the process of acquiring the grayscale compensation data is: firstly, capturing a brightness distribution of the liquid crystal display panel 1 under the grayscale of a white picture is by a camera 2, and then the compensation data calculation unit 3 calculates the grayscale compensation value of each region of the liquid crystal display panel 1 according to a corresponding curve of the brightness and the grayscale based on a center point of the liquid crystal display panel 1, and finally writes the grayscale compensation value to the flash card 13.

Referring to FIG. 6, the present invention further provides a Mura compensation optimization system for liquid crystal display panel, including a timing controller 11 electrically connected to a liquid crystal display panel 1. Wherein the timing controller 11 is provided with a receiving module 110, a detection determination function module 111 electrically connected to the receiving module 110 and a Mura compensation function module 113 electrically connected to the detection determination function module 111. The receiving module 110 is configured to receive an original picture data signal inputted from the liquid crystal display panel 1; the detection determination function module 111 is configured to detect the received original picture data signal and determine whether an original picture is a grayscale transition picture or a single grayscale value picture; the Mura compensation function module 113 is configured to turn off its own Mura compensation function when the original picture is a grayscale transition picture or not a single grayscale value picture, and is also used to turn on its own Mura compensation function when the original picture is a single grayscale value picture or not a grayscale transition picture.

Furthermore, the liquid crystal display panel Mura compensation optimization system further includes:

a camera 2 for capturing a brightness distribution of the liquid crystal display panel 1 under a grayscale of a white picture;

a compensation data calculation unit 3 electrically connected to the camera 2 for calculating a grayscale compensation value of each region of the liquid crystal display panel 1 according to a corresponding curve of the brightness and the grayscale based on a center point of the liquid crystal display panel 1; and a flash card 13 disposed on the periphery of the liquid crystal display panel 1 and electrically connected to the compensation data calculation unit 3 and the Mura compensation function module 113 for storing the grayscale compensation value.

There are two types of operation modes of the Mura compensation optimization system of the liquid crystal display panel.

First type: the detection determination function module 111 detects the received original picture data signal and determines whether the inputted original picture is a grayscale transition picture; if the determination is yes, the timing controller 11 controls the Mura compensation function module 113 to turn off the Mura compensation function, and directly output the uncompensated original picture data signal to the liquid crystal display panel 1. The output of the liquid crystal display panel 1 is a grayscale transition picture without Mura compensation, then the adjacent regions of the liquid crystal display on the panel 1 still maintains a fixed difference of one grayscale, and there is no display abnormality that the grayscale transition boundary is unable to be distinguished and the grayscale transition is not smooth. If the determination is no, the timing controller 11 controls the Mura compensation function module 113 to turn on the Mura compensation function, and the original picture data signal and the grayscale compensation data are outputted to the liquid crystal display panel 1 after performing a calculation, and the liquid crystal display panel 1 outputs a picture subjected to the Mura compensation, which eliminates or weakens the Mura phenomenon of the liquid crystal display panel 1, and the display brightness is more uniform.

Second type: the detection determination function module 111 detects the received original picture data signal and determines whether the inputted original picture is the single grayscale value picture; if the determination is yes, the timing controller 11 controls the Mura compensation function module 113 to turn on the Mura compensation function, and the original picture data signal and the grayscale compensation data are outputted to the liquid crystal display panel 1 after a calculation. The liquid crystal display panel 1 outputs a picture subjected to the Mura compensation, which eliminates or reduces the Mura phenomenon on liquid crystal display panel 1, and the display brightness is more uniform. If the determination is no, the timing controller 11 controls the Mura compensation function module 113 to turn off the Mura compensation function, and directly output the uncompensated original picture data signal to the liquid crystal display panel 1. The liquid crystal display panel 1 outputs the original picture without the Mura compensation, which can avoid the occurrence of display abnormality by performing Mura compensation on a specific picture such as a grayscale transition picture or a single grayscale value screen picture.

In summary, a Mura compensation optimization method for liquid crystal display panel of the present invention, through detecting the received original picture data signal and determining whether an original picture is a grayscale transition picture or a single grayscale value picture by a timing controller, when determining that the original picture is a grayscale transition picture or not a single grayscale value picture, turning off a Mura compensation function by the timing controller, which can avoid the occurrence of display abnormality by performing the Mura compensation on a specific picture such as the grayscale transition picture or the single grayscale value picture, optimizing the Mura compensation effect of the liquid crystal display panel. The Mura compensation optimization system for liquid crystal display panel, through detecting the received original picture data signal and determining whether an original picture is a grayscale transition picture or a single grayscale value picture by a timing controller, when determining that the original picture is a grayscale transition picture or not a single grayscale value picture, turning off a Mura compensation function by the timing controller, which can avoid the occurrence of display abnormality by performing the Mura compensation on a specific picture such as the grayscale transition picture or the single grayscale value picture, optimizing the Mura compensation effect of the liquid crystal display panel.

In the above, for those of ordinary skill in the art, various other changes and modifications can be made in accordance with the technical solutions and technical concept of the present invention, and all such changes and modifications are intended to be included within the protection scope of the claims of the present invention.

What is claimed is:

1. A Mura compensation optimization method for liquid crystal display panel, comprising steps of:

step S1: receiving an original picture data signal supplied to a liquid crystal display panel, detecting the received original picture data signal and determining whether an original picture is a grayscale transition picture or a single grayscale value picture by a timing controller; and step S2: when determining that the original picture is a grayscale transition picture or not a single grayscale value picture, turning off a Mura compensation function by the timing controller;

wherein Mura compensation applied to the original picture that is a grayscale transition picture or not a single grayscale value picture causes display abnormality and turning off the Mura compensation function keeps the original picture that is a grayscale transition picture or not a single grayscale value picture displayed in an original form without causing display abnormality resulting from Mura compensation.

2. The Mura compensation optimization method for liquid crystal display panel according to claim 1, the method further comprises a step of:

step S3: when determining that the original picture is the single grayscale value picture or not the grayscale transition picture, the timing controller turns on the Mura compensation function.

3. The Mura compensation optimization method for liquid crystal display panel according to claim 2, wherein in the step S1, the timing controller is provided with a receiving module and a detection determination function module electrically connected to the receiving module, and a Mura compensation function module electrically connected to the detection determination function module; the receiving module receives the original picture data signal inputted from the liquid crystal display panel, the detection determination function module detects the received original picture data signal and determines whether the inputted original picture is the grayscale transition picture;

in the step S2, when determining that the original picture is a grayscale transition picture, the timing controller controls the Mura compensation function module to turn off the Mura compensation function, and directly outputs the uncompensated original picture data signal to the liquid crystal display panel; and in the step S3, when determining that the original picture is not the grayscale transition picture, the timing controller controls the Mura compensation function module to turn on the Mura compensation function, and the original picture data signal and the grayscale compensation data are outputted to the liquid crystal display panel after performing a calculation.

4. The Mura compensation optimization method for liquid crystal display panel according to claim 2, wherein in the step S1, the timing controller is provided with a receiving module, a detection determination function module electrically connected to the receiving module, and a Mura compensation function module electrically connected to the detection determination function module; wherein the receiving module receives the original picture data signal input from the liquid crystal display panel, the detection determination function module detects the received original picture data signal and determines whether the inputted original picture is the single grayscale value picture;

in the step S2, when determining that the original picture is not the single grayscale value picture, the timing controller controls the Mura compensation function module to turn off the Mura compensation function, and directly outputs the uncompensated original picture data signal to the liquid crystal display panel; and in the step S3, when determining that the original picture is a single grayscale value picture, the timing controller controls the Mura compensation function module to turn on the Mura compensation function, and the original picture data signal and the grayscale compensation data are outputted to the liquid crystal display panel after a calculation.

5. The Mura compensation optimization method for liquid crystal display panel according to claim 3, wherein the grayscale compensation data is stored in a flash card electrically connected to the Mura compensation function module.

6. The Mura compensation optimization method for liquid crystal display panel according to claim 5, wherein a process of acquiring the grayscale compensation data is: firstly, capturing a brightness distribution of the liquid crystal display panel 1 under the grayscale of a white picture by a camera, and then a compensation data calculation unit calculates a grayscale compensation value of each region of the liquid crystal display panel according to a corresponding curve of the brightness and the grayscale based on a center point of the liquid crystal display panel, and finally writes the grayscale compensation value to the flash card.

7. The Mura compensation optimization method for liquid crystal display panel according to claim 1, wherein the single grayscale value picture may be a pure red picture, a pure green picture, a pure blue picture, a pure white picture, or a picture mixed by any two colors of red, green, and blue.

8. A Mura compensation optimization system for liquid crystal display panel, comprising:

a timing controller electrically connected to a liquid crystal display panel, wherein the timing controller is provided with a receiving module, a detection determination function module electrically connected to the receiving module and a Mura compensation function module electrically connected to the detection determination function module;

wherein the receiving module is configured to receive an original picture data signal supplied to the liquid crystal display panel;

wherein the detection determination function module is configured to detect the received original picture data signal and determine whether an original picture is a grayscale transition picture or a single grayscale value picture; and wherein the Mura compensation function module is configured to turn off its own Mura compensation function when the original picture is a grayscale transition picture or not a single grayscale value picture; and wherein Mura compensation applied to the original picture that is a grayscale transition picture or not a single grayscale value picture causes display abnormality and turning off the Mura compensation function keeps the original picture that is a grayscale transition picture or not a single grayscale value picture displayed in an original form without causing display abnormality resulting from Mura compensation.

9. The Mura compensation optimization system for liquid crystal display panel according to claim 8, wherein the system further comprises:

a camera for capturing a brightness distribution of the liquid crystal display panel under a grayscale of a white picture;

a compensation data calculation unit electrically connected to the camera for calculating a grayscale compensation value of each region of the liquid crystal display panel according to a corresponding curve of the brightness and the grayscale based on a center point of the liquid crystal display panel; and a flash card electrically connected to the compensation data calculation unit and the Mura compensation function module for storing the grayscale compensation value.

10. The Mura compensation optimization system for liquid crystal display panel according to claim 8, wherein the Mura compensation function module is also used to turn on its own Mura compensation function when the original picture is a single grayscale value picture or not a grayscale transition picture.

* * * * *